United States Patent [19]

Akechi

[11] Patent Number: 4,838,936

[45] Date of Patent: Jun. 13, 1989

[54] FORGED ALUMINUM ALLOY SPIRAL PARTS AND METHOD OF FABRICATION THEREOF

[75] Inventor: Kiyoaki Akechi, Hyogo, Japan

[73] Assignee: Sumitomo Electric Industries, Ltd., Osaka, Japan

[21] Appl. No.: 197,173

[22] Filed: May 23, 1988

[30] Foreign Application Priority Data

May 23, 1987 [JP] Japan ..... 62-126402
May 23, 1987 [JP] Japan ..... 62-126403
Oct. 16, 1987 [JP] Japan ..... 62-261290

[51] Int. Cl.[4] ..... C22C 39/12

[52] U.S. Cl. ..... 75/249; 75/232; 75/235; 75/236; 75/244; 419/10; 419/11; 419/12; 419/13; 419/17; 419/19; 419/23; 419/25; 419/39; 419/41; 419/42; 419/48; 419/53

[58] Field of Search ..... 75/232, 235, 236, 244, 75/249; 419/10–13, 17, 19, 23, 25, 39, 41, 42, 48, 53

[56] References Cited

U.S. PATENT DOCUMENTS 3,899,820 8/1975 Read et al. ..... 29/420.5
4,069,042 1/1978 Buchovecky et al. ..... 75/226
4,135,922 1/1979 Cebulak ..... 75/249
4,347,076 8/1982 Ray et al. ..... 75/249
4,597,792 7/1986 Webster ..... 75/249
4,702,885 10/1987 Odami et al. ..... 75/249
4,711,823 12/1987 Shiina ..... 75/249
4,722,751 2/1988 Akechi et al. ..... 75/232
4,732,610 3/1988 Hildeman et al. ..... 75/249

*Primary Examiner*—Stephen J. Lechert, Jr.
*Attorney, Agent, or Firm*—Sughrue, Mion, Zinn, Macpeak, and Seas

[57] ABSTRACT

Spiral parts, such as orbiting and fixed scroll plates having involute wraps, for use in scroll compressors, the parts having low coefficient of thermal expansion and high tensile strength and Young's modulus, are formed by combining a self-lubricating power into aluminum raw material powder prior to compression and forging. As an alternative to and in conjunction with the foregoing, temperatures during preform heating and in the die for forging are controlled to be in respective ranges of 300° to 500° C. and 150° to 500° C. Aluminum alloy fine powder preferably has a particle diameter no larger than 350 μm. The self-lubricating powder preferably forms 1 to 25% of the mix by volume, and contains at least one member selected from the group consisting of graphite, BN, and $MoS_2$. The aluminum raw material powder may contain at least one element selected from the group consisting of Cu, Mg, and Si, or a kind of compound particles from the group consisting of oxides, nitrides, borides, and carbides of Fe, Al, Mg, Ti, Zr, and Si.

21 Claims, 2 Drawing Sheets

FORGED ALUMINUM ALLOY SPIRAL PARTS AND METHOD OF FABRICATION THEREOF

BACKGROUND OF THE INVENTION

The present invention relates to aluminum alloy parts formed by forging aluminum alloy powder, such as orbiting and fixed scroll plates having involute wraps and the like, for use in a scroll-type compressor, and to a method of fabrication thereof.

Heretofore, when manufacturing spiral parts, such as orbiting and fixed scroll plates having involute wraps and the like, for use in a scroll-type compressor, the final finishing process has been performed by machining. The following methods have been used for preparing a shaped blank prior to final finishing: a casting method using cast-iron or a cast-aluminum alloy; an aluminum alloy die-casting method; a powder metallurgy method using iron sintered parts; a cold forging method using steel; and the like.

On the other hand, when manufacturing parts, such as connecting rods or the like, for use in a car, a powder forging technique has been used. The powder forging technique has not been practically use for aluminum parts, though it has been used for iron parts.

The aforementioned conventional manufacturing methods have the following disadvantages. The casting method using cast iron is disadvantageous in that the material used is heavy. Further, the accuracy of casting itself is so poor that machining is expensive. The machining time required is so long that cost cannot be reduced. Further, when thin parts are cast, defects such as blow holes and the like often arise.

The powder metallurgy method on iron sintered parts is disadvantageous in that the material used is heavy and inferior in airtightness because of the porosity (of the order of about ten per cent where the method is used for producing iron sintered parts). Further, the parts are so thin and spiral that high dimensional accuracy cannot be expected. Accordingly, it is difficult to reduce machining amount. Further, the machining of the parts must be carried out intermittently because of the presence of pores. Accordingly, machining speed cannot be increased.

The steel cold forging method is disadvantageous in that forging must be repeated to produce forged parts excellent in dimensional accuracy, so that cost cannot be reduced.

The aluminum alloy casting method and the die-casting method are disadvantageous in that an aluminum alloy to be used is limited to alloy compositions having good fluidity for thinning cast parts. Consequently, the thermal expansion coefficient of the cast aluminum alloy becomes relatively high and the Young's modulus thereof becomes relatively low, compared with an iron alloy. Further, it is difficult to maintain the strength and wear resistance at a predetermined level. Further, in the case where the Si content of the aluminum alloy to be used is high, the alloy cannot be machined at a high speed because of the coarse Si crystal grains, even though it may be possible to cast the alloy.

SUMMARY OF THE INVENTION

In view of the foregoing, it is an object of the present invention to provide a method of producing spiral parts which are light in weight and can be machined with ease, which are less expensive to machine and which have excellent dimensional accuracy, so that machining time and machining cost can be substantially improved.

It is another object of the present invention to provide a method of producing an aluminum powder forged alloy which is not sticked or welded into a die wall when forged.

It is a further object of the present invention to provide aluminum alloy parts which have a low coefficient of thermal expansion and which are superior in mechanical characteristics, such as Young's modulus and the like.

As one way of solving the aforementioned problems, the method of producing spiral parts by forging aluminum alloy powder according to the present invention comprises the following steps: forming a perform from aluminum alloy powder as a green compact blank by compressing by die assembly and cold isostatic pressing, and hot-forging the perform, wherein the aluminum alloy powder has a fine and homogeous micro-structure.

According to another aspect of the present invention, the problem in sticking or welding the aluminum alloy into die wall at the time of forging is solved by a method of producing an aluminum powder forged alloy, which comprises the steps of: forming a preform by compacting and/or extruding of a mixed powder containing 1% to 25% by volume of self-lubricating powder into aluminum raw material powder, the self-lubricating powder containing at least one member selected from the group consisting of graphite, boron nitride and molybdenum disulfide, the aluminum raw material powder consisting essentially of aluminum metal or alloy powder; and hot-forging the preform.

The amount of aluminum raw material powder may be adjusted corresponding to the composition of an Al alloy to be produced. In other words, the Al alloy powder may be used by itself or with at least one member selected from the element powder group consisting of Cu, Mg and Si or at least one member selected from the compound powder group consisting of oxides, nitrides, borides, and carbides of Fe, Al, Mg, Ti, Zr, Si and the like.

As a further aspect of the present invention, the provision of aluminum alloy parts of low thermal expansion coefficient and superior mechanical characteristics, such as Young's modulus and the like, is attained by forming low thermally expansive forged aluminum alloy spiral parts obtained by machining an aluminum raw material which is prepared by the following steps: compressing aluminum alloy fine powder having a particle diameter not larger than 350 $\mu$m and containing at least one element selected from the group consisting of silicon and transition elements, such as Mn, Fe, Ni or the like, in an amount required for preventing the coefficient of thermal expansion from being larger than $21\times10^{-6}$/°C.; hot-extruding or hot-forging the green compact and hot-forging the extruded material.

According to the present invention, the aluminum alloy powder raw material is not heavy and can be machined with ease. Also, the material need not be limited to alloy compositions with excellent fluidity characteristics. However, in order to produce a material which can be machined with ease, the aluminum alloy powder must have a fine and homogeneous microstructure. The fine and homogeneous micro-structure must be formed by rapidly solidifying at a cooling rate not lower than 100° C./sec. or by use of powder having a particle size not larger than 350 $\mu$m. In the case where the alloy contains a large number of elements such as Si, Fe and the like, it is preferable that the cooling rate is not lower than 1000° C./sec. or that the particle size is not larger than 150 μm. The powder may be mixed with other powder if necessary.

The aluminum alloy powder is compacted by die assembly or cold isostatic press. In the case of the aluminum powder, die pressing generally used in iron powder metallurgy is unsuitable because the powder is easily sticked or welded into the die wall. Lubricating agents such as wax or the like can be added to the powder, and the dewaxing process must be performed to prevent sticking or welding. However, the dewaxing process by heating is not easy in the case of aluminum powder, and if the dewaxing is not complete, there is much blister in the forged parts. Accordingly, it is better that the powder is compressed isostatically without lubricating agents such as wax which must be dewaxed.

Where the powder is compressed by cold isostatic press, a wet-type press is used for large-sized parts needing hard-carbide rolling. According to this method, a rubber mold containing powder is soaked in water, and pressure is applied to the water. According to the present invention, it is preferable for manufacturing efficiency and handling that a dry-back type cold isostatic press be used for relatively small parts such as spiral parts. A "dry-back type press" is a press in which the rubber mold containing powder and having a double-membrane structure receives pressure from another rubber membrane without directly touching water.

It often is desired that curing pressure be low when fine powder is used for ceramics or hard metal. However, according to the present invention, when rapidly solidified aluminum alloy powder is used, the particle size is large. Accordingly, curing pressure is not lower than 1 ton/cm$^2$, preferably 2 tons/cm$^2$.

The resulting preform is hot-forged to attain a rough or near net shape before the final finishing stage. If characteristics of the material, such as tensile strength, Young's modulus and the like do not reach necessary values or if dimensional accuracy must be further improved, the hot-forging procedure may be repeated. Particularly in the case where the cost required for machining as any accompanying process can be reduced greatly, the repetition of the hot-forging procedure is desired.

The last hot-forging procedure is specifically important as a shaping process. When aluminum alloy powder is used as a raw material, it is better that the last procedure is carried out by a friction press (screw press) in view of the stress-speed relation and the need for improvement in manufacturing efficiency.

Further, cold forging cannot be carried out because of low plasticity due to the large quantity of alloy elements. If the temperature is lower than 300° C., cracking occurs because of the absence of plastic flow. If the temperature is higher than 550° C., and liquid phase is partly produced so that normal forged material cannot be obtained. Consequently, it is preferable that the hot-forging by carried out at a temperature in a range between 350° and 500° C.

In a method for preventing sticking or welding between the aluminum alloy and the die, a powder of self-lubricating particles, such as graphite, boron nitride (BN), and molybdenum disulfide ($MoS_2$) is mixed in the Al raw material powder, whereby the sticking or welding at the time of forging can be prevented. As a result, the number of forging procedures can be reduced depending on the form of the forged material.

However, even in the method of the present invention, it is preferable that a lubricating agent such as graphite or the like be applied or sprayed to the die wall and/or the preformed material itself at the time of forging in order to eliminate a risk of sticking or welding.

Further, the Al powder forged alloy produced by the method of the present invention is excellent in resistance against sticking or welding and wear, because the powder contains self-lubricating particles.

The reasons for the quantity of the powder of self-lubricating particles mixed in the Al raw material powder being from 1% to 25% by volume as follows. If the quantity is smaller than 1% by volume, sticking or welding into the die occurs. If the quantity is larger than 25% by volume, llamellar cracking arises in the alloy at the time of forging, and the mechanical characteristics of the resulting Al alloy deteriorate. Further, the quantity of the powder of self-lubricating particles is limited by the characteristics of the forged material and depends on the form of the die and the forging conditions. Still further, sticking or welding into the die occurs more easily as the particle size of the Al or Al alloy powder decreases and as the Si content increases. Accordingly, the quantity of self-lubricating particles is selected from the aforementioned range based on these circumstances.

However, ordinarily it is preferable that the quantity of self-lubricating particles be from 3% to 10% by volume. In this range, the sticking or welding into the die can be effectively prevented without spoiling the mechanical characteristics of the Al powder forged alloy. Also, the Al powder forged alloy is wear resistant and has excellent resistance against sticking or welding.

Further, it is preferable that the quantity of powder of at least one element selected from the group of Cu, Mg and Si be from 0.2% to 10% by volume of the total quantity of the mixed powder. Also, it is preferable that the quantity of powder of at least one compound selected from the group of oxides, nitrides, borides, and carbides of elements, such as Fe, Al, Ti, Zr, Si, and the like be from 0.5% to 10% by volume of the total quantity of the mixed powder. If the quantity of the element or compound powder is larger than 10% by volume, severe sticking or welding into the die undesirably arises.

Because spiral parts produced from aluminum alloy parts which have a low thermal expansion coefficient and also have superior mechanical characteristics such as Young's modulus and the like, are combined with other parts made from other material such as cast iron when installed in a scroll compressor, it is preferable to use an aluminum alloy having a thermal expansion coefficient near the thermal expansion coefficient of cast iron ($12\times10^{-6}$/°C. Therefore, silicon or any transition metal, such as Mn, Fe, Ni and the like, may be added to the powder in an amount required to suppress the thermal expansion coefficient so that it is not larger than $21\times10^{-6}$/°C., preferably not larger than $19\times10^{-6}$/° C.

However, when a large amount of silicon or transition metal is added to the molten alloy to prepare an aluminum alloy having a low thermal expansion coefficient, Si crystal-grains (for example, in a cast Al-Si alloy or metallic compound crystals such as $Al_3Fe$ are enlarged in solid state, and at the same time, segregation occurs, so that the alloy cannot be machined easily. In order to solve this problem, aluminum alloy powder having a fine particle size not larger than 350 μm is used. To obtain such fine powder, a method of solidifying molten metal after atomizing is used must be suitably. The raw material of aluminum alloy powder having homogeneous and fine micro-structure thus prepared is compressed (for example, by a cold isostatic press), ordinarily in the form of an extrusion ballet, or of a preform for forging and then is hot-extruded or hot-forged.

In the case of hot-extrusion material, after the hot-extrusion, the resulting material is forged to produce a shaped blank for necessary aluminum alloy spiral parts. The shaped blank is finished up accurately by machining in the final manufacturing step to attain a finished article. If necessary, heat treatment may be applied at the same time. The resulting material has an entirely fine and homogeneous micro-structure and no blisters. Accordingly, the material is superior in airtightness. Further, it is a matter of course that the material has a low thermal expansion coefficient, high strength, and high Young's modulus, and that the material can be machined easily and can be plastically deformed easily.

Further, by adding the transition metal element to the powder in the amount required for suppressing the size of crystalline grains and precipitates produced in the aluminum alloy powder formed material to be not larger than 30 μm, the micro-structure of the aluminum alloy powder formed material can be made finer and more homogenized.

BRIEF DESCRIPTION OF THE DRAWINGS

The present invention will be described in detail with reference to the accompanying drawings, in which.

DETAILED DESCRIPTION OF THE PREFERRED EMBODIMENT

The present invention now will be described in detail with reference to the following specific embodiments and accompanying drawings.

EMBODIMENT I

Al-20Si-5Fe powder prepared as an aluminum alloy powder was selected, based on experimentation, as a raw material suited to a method of producing spiral parts according to the present invention. Spiral parts were produced by hot-forging primarily to investigate the influences of preform-heating condition, die temperature, and the like.

The spiral parts were produced as follows.

Figure 1:
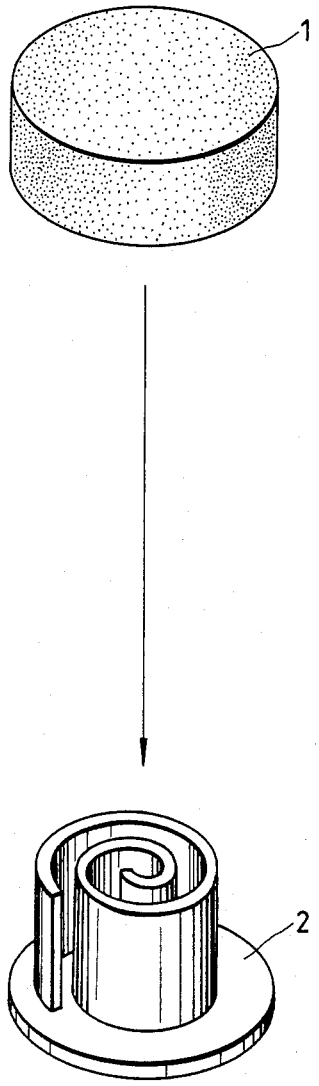
FIG. 1 shows a one-step forging process in which an aluminum alloy powder preformed material is forged.
Figure 2:
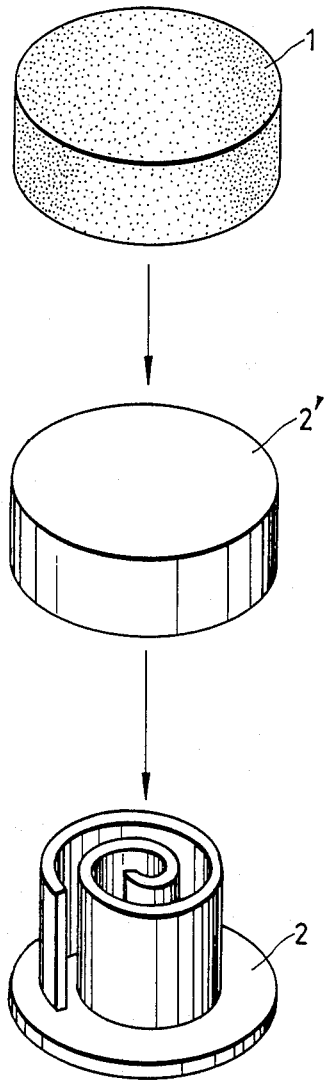
FIG. 2 shows a two-step forging process in which aluminum alloy powder preformed material is forged in advance and then is additionally forged.

Air-atomized Al-20Si-5Fe powder with a particle diameter not larger than 350 μm (−42 mesh) was compressed by wet-type cold isostatic press at a pressure of 1.5 tons/cm$^2$ to form a column of material with a diameter of 98 mm and a length of 40 mm (in which the relative desity of the green compact 1 was 70%). The green compact was forged in the following temperature conditions by a friction press to prepare a spiral part 2 (that is, a orbiting scroll plate with involute wraps), with a diameter of 100 mm, a plate thickness of 10 mm, a spiral thickness of 8 mm, and a height of 20 mm (Refer to FIG. 1).

TABLE 1

| Symbol | Preform-heating condition | Die temperature | Result | Remarks |
|---|---|---|---|---|
| (a) | 450° C. air | 250° C. | O | * |
| (b) | 450° C. air | 100° C. | X | Cracking |
| (c) | 450° C. Ar | 250° C. | O | Similar to (a) |
| (d) | 450° C. $N_2$ | 250° C. | O | Similar to (a) |
| (e) | 250° C. air | 250° C. | X | Cracking |
| (f) | 570° C. air | 250° C. | X | Breaking |

(Note)
*Tensile strength 35 kgf/mm$^2$
Young's modulus 10,000 kg/mm$^2$
Impact stress 1 kg · m/cm$^2$
Thermal expansion coefficient 16 × 10$^{-6}$/°C.

It was apparent from the aforementioned experiment that cracking occurs in the case (e) where the preform temperature is too low (250° C.) or in the case (f) where the preform temperature is too high (570° C.). Further, 100° C., as in case (b), is too low for the die temperature.

With respect to the preform-heating atmosphere, there is no difference between an atmosphere of air and the atmosphere of an inert or inactive gas, such as Ar (argon), $N_2$ (nitrogen) and the like, as shown in Table 1.

EMBODIMENT II

In order to attain a powder composition most suited as an aluminum alloy powder material, the following four powder compositions were selected and examined.

(A) Al-20Si-5Fe
(B) Al-35Si-2Ni
(C) Al-40Si
(D) Mixed powder (Al-20Si-5Fe powder+4% graphite powder)

Powder (air-atomized powder with a diameter not larger than 350 μm) in each of the aforementioned compositions was compressed by a dry-bag type cold isostatic press at pressure of 3 tons/cm$^2$ to form a column of material with a diameter of 98 mm and length of 35 mm (in which the relative density of the green compact 1 was 80%). The green compact was forged in the following conditions, respectively (where the form of the forged material was the same as that in Embodiment I).

TABLE 2

| Symbol | Preform-heating condition | Die temperature | Result | Remarks |
|---|---|---|---|---|
| (h) | 450° C. air (A) | 250° C. | O | *(Refer to Table 1) |
| | (forging) (B) | 250° C. | X | Cracking (Bad plastic flow) |
| | (C) | 250° C. | X | |
| | (D) | 250° C. | X | |
| (h') | 500° C. air (A) | 250° C. | O | |
| | (forging) (B) | 250° C. | X | Cracking (Bad plastic flow) |
| | (C) | 250° C. | X | |
| | (D) | 250° C. | X | |
| (h'') | 550° C. air (A) | 250° C. | O | |
| | (forging) (B) | 250° C. | X | Cracking (Bad plastic flow) |
| | (C) | 250° C. | X | |
| | (D) | 250° C. | X | |
| (i) | 450° C. air (A) | 250° C. | O | Similar to (a) |
| | pre-forging(B) | 250° C. | O | Similar to (a) |

TABLE 2-continued

| Symbol | Preform-heating condition | Die temperature | Result | Remarks |
|---|---|---|---|---|
| | (θ99 × 27 l) (C) | 250° C. | O | Similar to (a) |
| | ↓ (D) | 250° C. | O | Similar to (a) |
| | forging(spiral) | | | in TABLE 1 |

From Table 2, it is apparent that in the case (h) where the green compact formed by compressing powder is forged directly to produce the spiral form, the respective compositions (B), (C) and (D) are so poor in plastic flow that cracking occurs. Consequently, in this case, normal forged parts cannot be obtained except with the composition (A). Also in the cases (h') and (h'') where only the preform-heating condition is changed (to be 500° C. and 550° C., respectively) the same result is obtained.

The case (i) is different from the aforementioned cases where forging is directly performed after compression. In the case (i), spiral parts are produced by a two-step hot forging method comprising the steps of: hot-forging the green compact in advance to form a preforged material 2'; and hot-forging the preforged matter 2'. In this case, as shown in Table 2, good spiral parts, that is, orbiting or fixed scroll plates with involute wraps in scroll compressor, can be produced though any one of the powder compositions (A), (B), (C) and (D) is used.

EMBODIMENT III

Powder containing 0–30% by volume of graphite powder (with a particle size not larger than 150 μm) was mixed into Al-27 wt % Si-4 wt % Cu-0.5 wt % Mg alloy powder (with a particle size not larger than 150 μm) as shown in Table 3. The resulting mixture was compressed at a pressure of 4 tons/cm$^2$ to form a green compact with a diameter of 50 mm and a length of 50 mm. The green compact (relative density: 80%) was used as a preform for forging. The preform heated to 450° C. was hot-forged with a die after a graphite lubricant was applied to the die wall. While checking the condition of sticking or welding of the preform material into the die, the tensile strength of the resulting Al powder forged alloy and the load at the first occurrence of sticking or welding in friction test between the produced material and a reference material S45C were measured as shown in Table 3.

TABLE 3

| Sample | Quantity of graphite (vol %) | Presence of sticking or welding after forging | Tensile strength (kgf/mm$^2$) | Load at the first occurrence of sticking or welding during friction test (kg/mm$^2$) |
|---|---|---|---|---|
| 1* | 0 | Presence | 45 | 100 |
| 2* | 0.5 | Presence | 44 | 170 |
| 3 | 4 | Absence | 42 | 510 |
| 4 | 8 | Absence | 35 | 560 |
| 5 | 15 | Absence | 20 | 600 |
| 6* | 30 | Cracking | — | — |

(Note)
*shows comparative samples

EMBODIMENT IV

Powder containing 5% by weight and 10% by weight of BN powder (with a particle size not larger than 150 μm) was mixed into Al-35 wt % Si alloy powder (with a particle size not larger than 250 μm). The mixture was compressed at pressure of 1.5 tons/cm$^2$ to form a green compact of size 175 mm (diameter)×300 mm (length). The compressed material was heated to 450° C. and extruded to a diameter 50 mm. The extruded material was cut into 40 mm lengths to prepare a preformed material for forging. The preformed matter was heated to 450° C. and hot-forged to form a bottomed pipe-like matter of 55 mm (external diameter)×40 mm (internal diameter)×5 mm (bottom thickness) with a die after a graphite lubricant was applied to the die wall. As the result, the forging could be made without sticking or welding into the die.

However, in the case where Al-35 wt % Si alloy powder without BN powder was forged in the same manner as described above, sticking or welding into the die occurred.

As described above, the Al powder forged alloy produced according to the present invention contains self-lubricant particles so that the forged alloy itself has excellent resistance to sticking or welding and also has excellent wear resistance. Accordingly, the forged alloy is suited as a material used for various types of slidable parts. In the following, there is described an embodiment in which orbiting and fixed scroll plates having involute wraps in a scroll type compressor, which are complex in form so as to be thin and spiral, are produced according to the present invention.

EMBODIMENT V

Powder containing 5–10% by weight of graphite powder, BN powder or $MoS_2$ powder was mixed into Al-20 wt % Si-5 wt % Fe alloy powder (with a particle size not larger than 150 μm). The resulting mixture was compressed at a pressure of 5 tons/cm$^2$ by die assembly to form a green compact of size 90 mm (diameter)×40 mm (length). As a comparative example, Al-20 wt % Si-5 wt % Fe alloy powder not containing self-lubricant particles was compressed in the same manner as described above. In the case where the Al-20 wt % Si-5 wt % Fe alloy powder was used alone, sticking or welding into the die occurred. However, in the case where the alloy powder contained self-lubricant particles, sticking or welding into the die did not occur.

The respective green compact thus prepared was used as a preform for forging. The preform was heated to 500° C. and hot-forged to form a forged material of size 100 mm (diameter)×26 mm (length) with a die after a graphite lubricant was applied to the die wall. Further, the forged material was heated to 500° C. and hot-forged to produce a spiral part of 105 mm (external diameter) in the same condition. In the case where the Al-20 wt % Si-5 wt % Fe alloy powder was used alone, sticking or welding into the die occurred easily in spite of the application of graphite to the die wall. However, in the case where the alloy powder contained any type of self-lubricant particles, not only there is no occurrence of sticking or welding but also there is no occurrence of cracking. Consequently, in this case, good spiral parts could be obtained.

The respective resulting material was machined to form both the orbiting and fixed scroll plates having involute wraps as finished parts for the purpose of performing a practical test of scroll compressor. As the result of the test, the orbiting or fixed plate having involute wraps containing self-lubricant particles showed excellent in resistance against sticking or welding between each involute wraps. In contrast, for both the orbiting and fixed scroll plates having involute wraps which did not contain self-lubricant particles, sticking or welding between each involute wraps occurred in about five hours, making the operation impossible.

EMBODIMENT VI

Powder containing Si powder, Cu powder, 1% by volume of Mg powder, and 15% by volume of graphite powder was mixed into Al powder (with a particle size not larger than 250 μm). The mixture was compressed and hot-forged in the same manner as described above in Embodiment III to prepare a forged material. As result sticking or welding did not occur both in compacting by die assembly and in hot-forging.

Further, orbiting and fixed scroll plates with involute wraps formed by machining the forged material showed excellent resistance to sticking or welding between each involute wraps. In contrast, for the forged material which was prepared in the same manner as described above except that it did not contain graphite powder, sticking or welding occurred not only in hot-forging but also in compacting.

EMBODIMENT VII

Powder containing 10% by volume of graphite powder and 5% by volume of $Al_2O_3$ powder (with a mean particle size of 1.5 μm) was mixed into Al-30 wt % Si alloy powder (with a particle size not larger than 250 μm). The resulting mixture was compressed and hot-forged in the same manner as described above in Embodiment III to prepare a forged material. As a result, sticking or welding did not occur either in compacting or in hot-forging. Further, in a practical test about scroll compressor, the orbiting and fixed scroll plates with involute wraps formed by machining the forged material showed excellent wear resistance and resistance to sticking or welding between each involute wraps. In contrast, for the forged material which was prepared in the same manner as described above except that it did not contain graphite powder, sticking or welding into the die wall occurred not only in hot forging but also in compacting.

EMBODIMENT VIII

Spiral parts formed from raw material powder having a composition of Al-25 wt % Si-3% Cu-1% Mg as one example of aluminum alloy spiral parts according to the present invention were compared with cast-Al alloy or cast-iron spiral parts with respect to the machining time. The following results were obtained.

Figure 3:
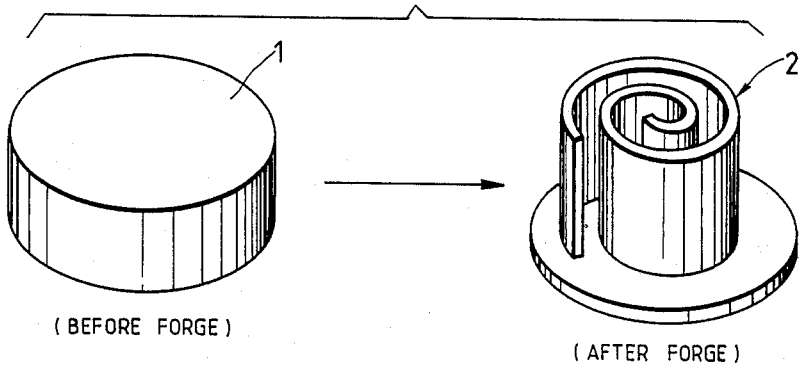
FIG. 3 shows a process according to the present invention in which preformed material 1 formed by compressing an aluminum powder raw material is hot-forged to produce a spiral part 2.

The aforementioned raw material powder was air-atomized powder with a particle diameter not larger than 350 μm (−42 mesh). The powder was compressed by cold isostatic pressing (at pressure of 1.5 tons/cm$^2$) to form a green compact, which was heated to 450° C. and hot-extruded to prepare a round bar with a diameter of 100 mm. The round bar was cut into 30 mm lengths for use as a preform for forging. The preform was hot-forged at 450° C. to produce spiral parts (FIG. 3).

Comparative materials were prepared from cast-aluminum alloys, such as AC8B and AC9B, and cast-iron FC25. The comparative materials were machined up to finishing accuracy. The forged spiral parts were compared with each other as to the machining time required for obtaining the spiral parts.

TABLE 4

| Materials | Machining time |
|---|---|
| Powder alloy Al—25Si—3Cu—1Mg | 4 minutes |
| Cast aluminum alloy AC8B | 6 minutes |
| Cast aluminum alloy AC9B | 10 minutes |
| Cast iron FC25 | 25 minutes |

In the case where a cast aluminum alloy AC9B was used as a comparative material, cracking arose so remarkably that normal spiral forged parts could not be produced.

It is apparent from Table 4 that the spiral parts according to the present invention in which aluminum alloy powder is used as raw material require substantially less machining time, yielding correspondingly reduced machining cost.

Because the thermal expansion coefficient of the Al-25Si-3Cu-1Mg alloy is as low as $16\times10^{-6}$/°C., the clearance about scroll plates can be much smaller. Further, the tensile strength and Young's modulus of the alloy are as high as 45 kgf/mm$^2$ and 9,600 kgf/mm$^2$, respectively. Accordingly, there is no problem in designing the spiral parts, that is, the orbiting or fixed scroll plates with involute wraps.

EMBODIMENT IX

Spiral parts formed from raw material powder having a composition of Al-25% Si-3% Cu1% Mg as another example of aluminum alloy spiral parts according to the present invention were compared with spiral parts formed from conventional cast aluminum alloy AC9B (Al-20% Si-1% Ni) with respect to the cutting property. The results are shown in FIG. 4, in which P/M Al-20Si-5Fe represents one of the alloys according to the present invention.

Figure 4:
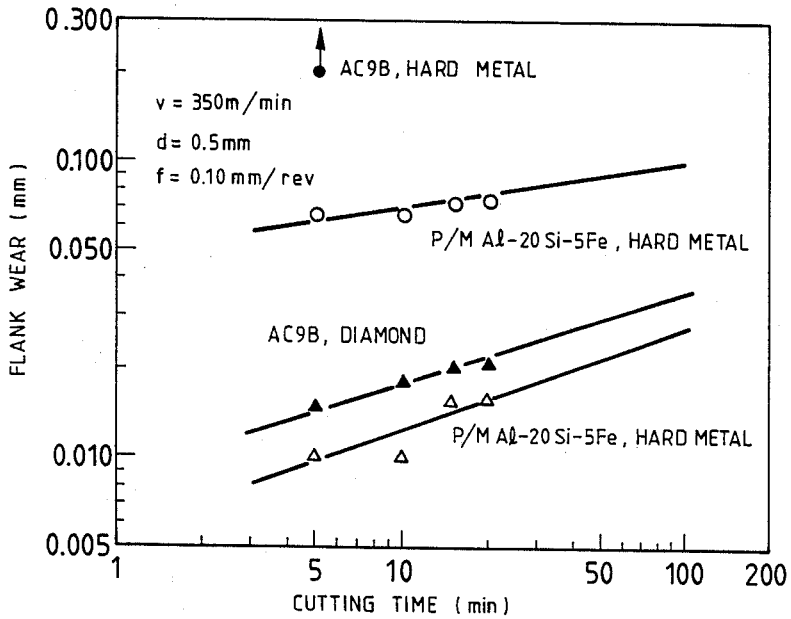
FIG. 4 is a characteristic graph (P/M Al-20Si-5Fe) showing a comparison in machinability between extruded material from aluminum alloy powder as Embodiment IX of the present invention and cast aluminum alloy JIS AC9B (Al-20Si-1Ni).

It is apparent from FIG. 4 that the flank wear of a cutting tool after cutting P/M Al-20Si-5Fe powder alloy is less than that of the cutting tool after cutting AC9B, in any case where the cutting tool is made of hard metal or diamond.

The P/M Al-20Si-5Fe powder alloy parts having the aforementioned characteristics are formed in the same manner as described above in Embodiment VIII. Accordingly, as described above, the raw material powder must have a particle size not larger than 350 μm (−42 mesh). The powder can be formed by rapidly solidifying at a cooling rate not lower than 100° C./sec. If the cooling rate is lower than 100° C./sec or if the particle size is larger than 350 μm, the degree of fine and homogeneous micro-structure is reduced, deteriorating the machinability and plasticity thereof, so that cracking or breaking arises during forging.

Further, because the P/M Al-20Si-5Fe alloy material extruded from rapidly solidifying alloy powder has favorable characteristics of low thermal expansion coefficient, high strength and high wear resistance, the material has been used as vanes in an air-conditioning rotary compressor for a car.

As described above in detail, according to Embodiments I and II, a preform is formed by compacting aluminum alloy powder having a fine and homogenous micro-structure as a raw material. Further, the preform is hot-forged. Accordingly, manufacturing cost is reduced and the time required for machining is reduced. Consequently, the method of producing spiral parts according to Embodiments I and II has the effect of reducing manufacturing cost considerably.

According to Embodiments III through VII, sticking or welding into the die does not occur during the hot-forging procedures. Accordingly, the hot-forging procedures can be reduced in number, and further, aluminum powder forged alloy having excellent forged surface appearance and dimensional accuracy can be produced.

Further, the resulting aluminum powder forged alloy containing self-lubricant particles itself has resistance against sticking or welding, and wear. Accordingly, the alloy is suited as a material for slidable parts, and particularly, aluminum alloy parts, such as orbiting and fixed scroll plates having involute wraps and the like, used in a scroll-type compressor can be provided at low cost.

According to Embodiments VIII and IX, the spiral parts can be easily combined with other parts made from cast iron and the like, because the thermal expansion coefficient of the spiral parts is low. Further, the forged material has a fine and homogeneous micro-structure, because the forged material is formed by rapidly solidified alloy powder as a raw material. Accordingly, the micro-structures of the spiral parts are free from segregation, rough crystallization and precipitation, so that the spiral parts have a lot of advantages in lightness, good machinability, and high wear resistance.

While the inventive method and resulting structure have been described in detail with reference to a number of specific embodiments, various modification within the spirit of the invention will be apparent to ordinarily skilled artisans. Thus, the invention should be considered as limited only by the scope of the appended claims which follow immediately

What is claimed is:

1. A method of producing spiral parts such as orbiting or fixed scroll plates with involute wraps by forging aluminum alloy powder, said method comprises the following steps:

forming a preform from aluminum alloy powder having fine and homogeneous micro-structures as raw material by one of compressing with die assembly and cold isostatic pressing; and hot-forging said preform.

2. A method according to claim 1, wherein said fine and homogeneous micro-structure of said aluminum alloy powder is formed by one of rapidly solidifying at a cooling rate of at least 100° C./sec. and use of said powder with a particle size not larger than 350 μm.

3. A method according to claim 1, wherein, in the case of said cold isostatic pressing, said preform is formed under pressure not lower than 1 ton/cm$^2$ by use of a dry-bag type cold isostatic press.

4. A method according to claim 2, wherein, in the case of said cold isostatic pressing, said preform is formed under pressure not lower than 1 ton/cm$^2$ by use of a dry-bag type cold isostatic press.

5. A method according to claim 1, wherein said hot-forging of said preform is carried out by the steps of:

hot-forging said preform to a simple or near net shape in advance; and repeating the hot-forging of the resulting preformed and forged material a sufficient number of times to produce said preform.

6. A method according to claim 2, wherein said hot-forging of said preform is carried out by the steps of:

hot-forging said preform to a simple or near net shape in advance; and repeating the hot-forging of the resulting preformed and forged material a sufficient number of times to produce said preform.

7. A method according to claim 3, wherein said hot-forging of said preform is carried out by the steps of:

hot-forging said preform to a simple or near net shape in advance; and repeating the hot-forging of the resulting preformed and forged material a sufficient number of times to produce said preform.

8. A method according to claim 1, wherein said hot-forging is carried out at a preform heating temperature of from 300° to 500° C. and at a die temperature of from 150° to 500° C.

9. A method according to claim 2, wherein said hot-forging is carried out at a preform heating temperature of from 300° to 500° C. and at a die temperature of from 150° to 500° C.

10. A method according to claim 3, wherein said hot-forging is carried out at a preform heating temperature of from 300° to 500° C. and at a die temperature of from 150° to 500° C.

11. A method according to claim 4, wherein said hot-forging is carried out at a preform heating temperature of from 300° to 500° C. and at a die temperature of from 150° to 500° C.

12. A method of producing aluminum powder forged alloy, said method comprising the following steps:

forming a preform by one of compression and extrusion of a powder mix containing 1 to 25% by volume of self-lubricating powder and aluminum raw material powder, said self-lubricating powder containing at least one member selected from the group consisting of graphite, boron nitride and molybdenum disulfide, said aluminum raw material powder consisting essentially of one of aluminum metal and alloy powder; and hot-forging said preform.

13. A method according to claim 12, wherein said aluminum raw material powder further contains at least one member selected from the element powder group consisting of copper, magnesium and silicon.

14. A method according to claim 12, wherein said aluminum raw material further contains at least one member selected from the compound powder group consisting of oxides, nitrides, borides and carbides of iron, aluminum, magnesium, titanium, zirconium and silicon.

15. A forged aluminum alloy spiral part having a low coefficient of thermal expansion, wherein said part is produced by machining an aluminum alloy material prepared by the following steps:

compressing aluminum alloy fine powder having a particle diameter no greater than 350 μm and containing at least one element selected from the group consisting of Si, Mn, Fe, and Ni, in an amount sufficient to prevent said coefficient of thermal expansion form being greater than $21\times10^{-6}$/°C.;

hot-extruding the compressed powder; and hot-forging the extruded material, or hot-forging the compressed powder.

16. A forged aluminum alloy spiral part according to claim 15, wherein said aluminum alloy fine powder having a particle diameter not larger than 350 μm is formed by rapidly solidifying at a cooling rate not lower than 100° C./sec.

17. A forged aluminum alloy spiral part according to claim 15, wherein a grain size in micro-structure of the material is not larger than 30 μm.

18. A method according to claim 8, wherein said hot-forging is carried out by use of a friction press.

19. A method according to claim 9, wherein said hot-forging is carried out by use of a friction press.

20. A method according to claim 10, wherein said hot-forging is carried out by use of a friction press.

21. A method according to claim 11, wherein said hot-forging is carried out by use of a friction press.

* * * * *